US007170383B2

(12) United States Patent
Polivka et al.

(10) Patent No.: US 7,170,383 B2
(45) Date of Patent: Jan. 30, 2007

(54) METHOD AND APPARATUS FOR TRANSFERRING ENERGY IN A POWER CONVERTER CIRCUIT

(75) Inventors: William M. Polivka, Campbell, CA (US); David Michael Hugh Matthews, Sunnyvale, CA (US)

(73) Assignee: Power Integrations, Inc., San Jose, CA (US)

( * ) Notice: Subject to any disclaimer, the term of this patent is extended or adjusted under 35 U.S.C. 154(b) by 120 days.

(21) Appl. No.: 11/070,434

(22) Filed: Mar. 1, 2005

(65) Prior Publication Data

US 2005/0146831 A1 Jul. 7, 2005

Related U.S. Application Data

(62) Division of application No. 10/617,245, filed on Jul. 9, 2003.

(51) Int. Cl.
*H01F 5/00* (2006.01)

(52) U.S. Cl. ..... 336/200

(58) Field of Classification Search ..... 336/65, 336/83, 192, 200; 323/355
See application file for complete search history.

(56) References Cited

U.S. PATENT DOCUMENTS

| | | | | |
|---|---|---|---|---|
| 5,124,681 | A | 6/1992 | Chen | |
| 5,506,764 | A * | 4/1996 | Hon et al. | 363/21.16 |
| 5,719,547 | A | 2/1998 | Kaneko et al. | |
| 5,737,203 | A * | 4/1998 | Barrett | 363/75 |
| 5,760,669 | A | 6/1998 | Dangler et al. | |
| 6,535,095 | B2 | 3/2003 | Aoki et al. | |
| 6,611,187 | B2 * | 8/2003 | Matsumoto et al. | 336/110 |
| 7,012,414 | B1 * | 3/2006 | Mehrotra et al. | 323/306 |
| 2004/0164834 | A1 | 8/2004 | Tolle et al. | |

OTHER PUBLICATIONS

Watson, J.K., "Applications of Magnetism", University of Florida, 1980, Figure 6.40 (a), p. 277, John Wiley & Sons.
Erickson, Robert W. et al., "Fundamentals of Power Electronics", University of Colorado, 2001, p. 501, Figure 13.13, Kluwer Academic Publishers.
Close, Charles M., "The Analysis of Linear Circuits", Rensselaer Polytechnic Institute, 1966, p. 335, Figures 7.1-2 (a) and (c), Harcourt, Brace & World, Inc.
Col. McLyman, Wm. T., "Magnetic Core Selection for Transformers and Inductors", Jet Propulsion Laboratory, California Institute of Technology, 1997, p. 309 and 403, Figures 135 and 139, Marcel Dekker, Inc.
"Ferrites and Accessories", Data Book 1999, p. 565, Siemens Matsushita Components GmbH & Co. KG.
"Core Banding Data", Cut Cores Design Manual and Catalog (MCC-200), www.mag-inc.com/pdf/MCC-200.pdf, p. 5, Magnetics.

* cited by examiner

*Primary Examiner*—Tuyen T. Nguyen
(74) *Attorney, Agent, or Firm*—Blakely, Sokoloff, Taylor & Zafman, LLP

(57) ABSTRACT

A reduced cost energy transfer element for power converter circuits. In one embodiment, an energy transfer element according to an embodiment of the present invention includes a magnetic element having an external surface with at least a first winding and a second winding wound around the external surface of the magnetic element without a bobbin. As such, energy to be received from a power converter circuit input is to be transferred from the first winding to the second winding through a magnetic coupling provided by the magnetic element to a power converter circuit output.

15 Claims, 10 Drawing Sheets

METHOD AND APPARATUS FOR TRANSFERRING ENERGY IN A POWER CONVERTER CIRCUIT

CROSS-REFERENCE TO RELATED APPLICATIONS

This application is a divisional of, and claims priority under 35 U.S.C. §120 from, U.S. patent application Ser. No. 10/617,245, filed Jul. 9, 2003, and still pending.

BACKGROUND OF THE INVENTION

1. Field of the Invention

The present invention relates generally to magnetic devices, and more specifically, the present invention relates to components that transfer energy in power converters. It involves a method of construction that reduces the cost of inductors and transformers that have more than one winding.

2. Background Information

Most modern electronic equipment requires a regulated source of direct current (DC) voltage to operate. The magnitude of the regulated voltage is typically less than 20 volts. Often the regulated DC voltage must be obtained from an unregulated source of DC or alternating (AC) voltage that has a magnitude several times greater than the desired regulated value. It is the purpose of electronic power supplies to provide the regulated voltage from the unregulated source.

Typical power supplies commonly utilize an energy transfer element to change the magnitude of one voltage or current to a different voltage or current. FIG. 1 shows an example of a common construction for an energy transfer element. As shown, the energy transfer element includes a magnetic element 100, a primary winding 101 that forms a primary port P1, and a secondary winding 102 that forms a secondary port S1. The two-dimensional drawing in FIG. 1 shows that the structure of the magnetic element 100 is a toroid.

The important characteristic of the toroidal structure is that the magnetic element defines a closed structure with a hole such that the magnetic element completely surrounds every turn of every winding. As a consequence of this closed construction, one end of each of the windings 101 and 102 must be threaded or pass through the hole defined by the inner diameter 103 of the circular structure. This restriction complicates the manufacturing process. Manufacturing becomes increasingly difficult and more costly as the inner diameter 103 gets smaller. The curvature of the circular hole in magnetic element 100 is an additional complication to the application of windings.

FIG. 2 is a modification to the toroidal structure of the magnetic element 100 in FIG. 1. The structure of the magnetic element 200 in FIG. 2 is a closed construction like magnetic element 100. The major difference between magnetic element 200 and magnetic element 100 is that the hole in magnetic element 200 is formed from sections that are defined by straight lines, whereas the geometry about the hole of magnetic element 100 is curved. The closed rectangular structure of magnetic element 200 has the same fundamental problems with manufacturability and high cost as the closed circular structure of magnetic element 100. One end of windings 201 and 202 must be threaded or pass through the inner rectangular area 203.

The problem of manufacturability is generally addressed by the technique illustrated in FIG. 3. The closed structure of the magnet element 200 of FIG. 2 has been separated into the two pieces 300 and 301 having open structures in FIG. 3. Additionally, two tubes 302 and 303 of a rigid nonmagnetic material that is also an electrical insulator are introduced to hold the windings 304 and 305. One familiar with the construction of magnetic components for power converters will recognize 302 and 303 as bobbins. A bobbin is a rigid structure of an electrically insulating nonmagnetic material that holds windings for a magnetic element, to provide mechanical support and to maintain the relative positions of the windings when the magnetic element is absent. One familiar with bobbins for magnetic elements will know that bobbins typically contain conductive pins that terminate the ends of the windings, but are not necessary to realize the main advantages of the technique illustrated in FIG. 3.

The technique of constructing a magnetic device that has a closed structure from multiple elements that have open structures, shown by example in FIG. 3, removes the restriction that requires the ends of the windings to pass through an opening in a closed structure such as those in FIG. 1 and FIG. 2. However, this benefit to manufacturing is often defeated by the additional cost of the bobbins.

SUMMARY OF THE INVENTION

An apparatus and a method for transferring energy in a power converter circuit is disclosed. In one embodiment, an energy transfer element according to an embodiment of the present invention includes a magnetic element having an external surface with at least a first winding and a second winding wound around the external surface of the magnetic element without a bobbin. As such, energy to be received from a power converter circuit input is to be transferred from the first winding to the second winding through a magnetic coupling provided by the magnetic element to a power converter circuit output. Additional features and benefits of the present invention will become apparent from the detailed description, figures and claims set forth below.

BRIEF DESCRIPTION OF THE DRAWINGS

The present invention detailed illustrated by way of example and not limitation in the accompanying Figures.

DETAILED DESCRIPTION

Figure 1:
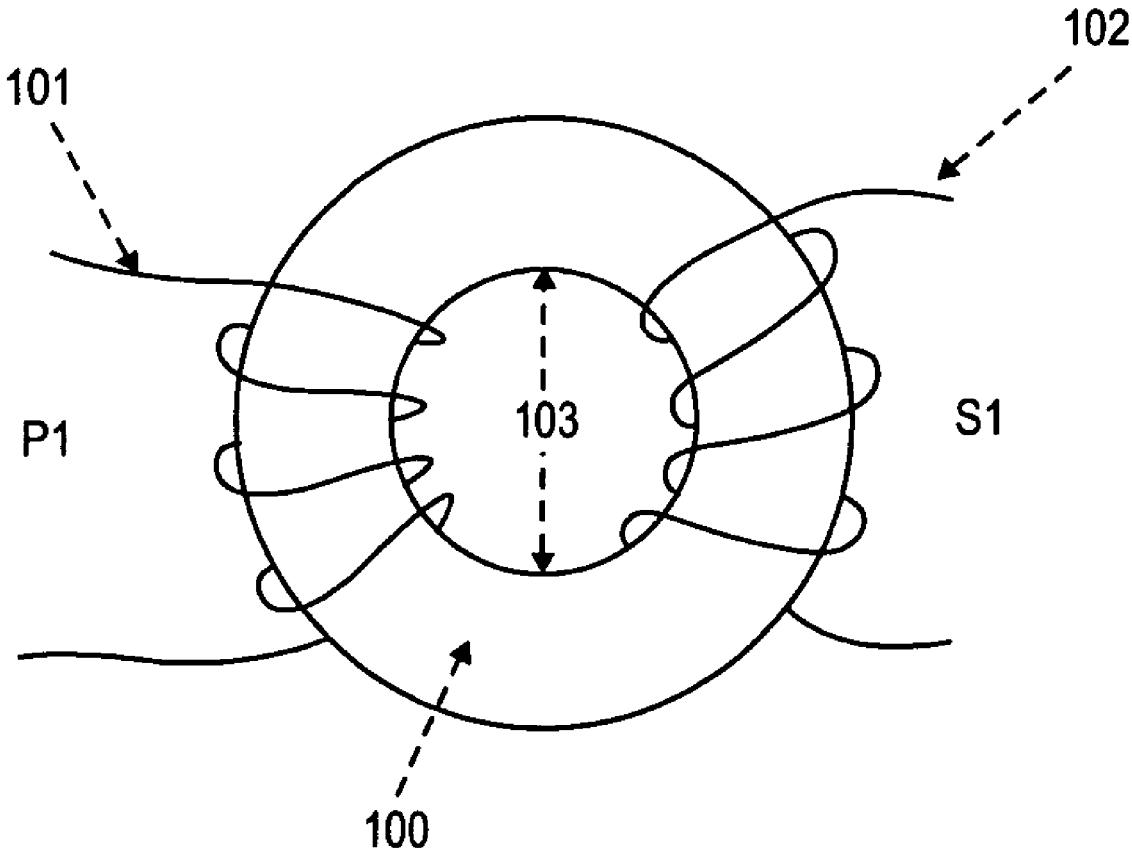
FIG. 1 (PRIOR ART)
FIG. 1 shows a typical construction of an energy transfer element that uses a magnetic element with a closed structure and two windings. The windings occupy sections of the magnetic element that are curved.
Figure 2:
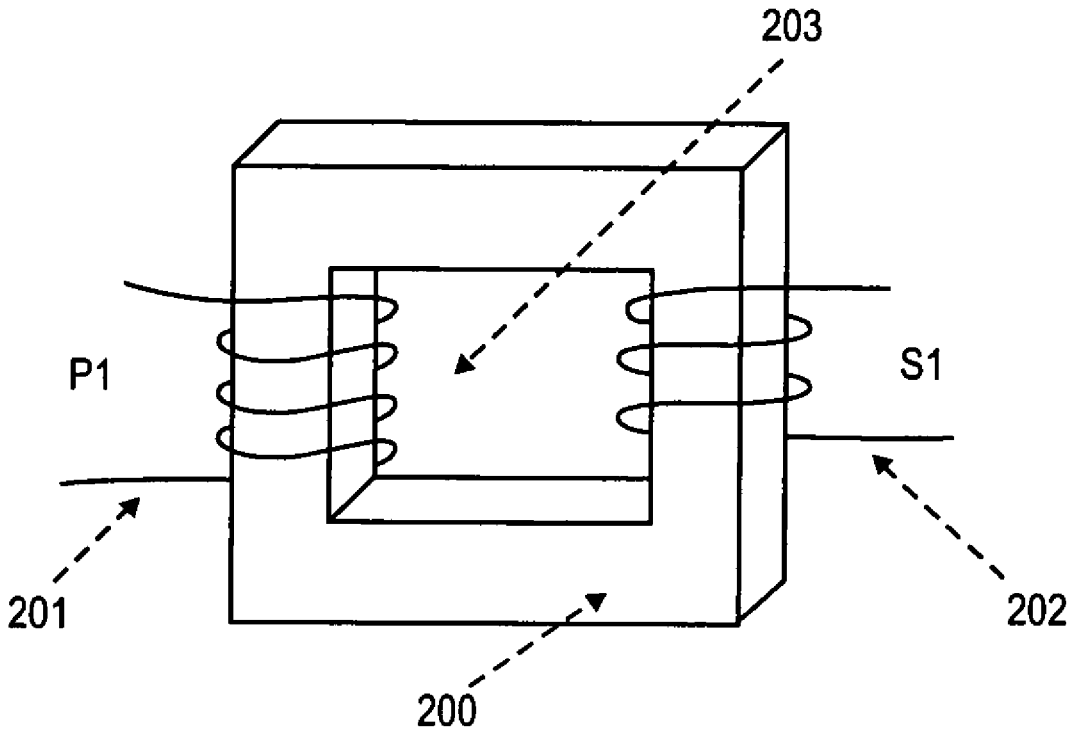
FIG. 2 (PRIOR ART)
FIG. 2 shows a construction of an energy transfer element that uses a magnetic element with a closed structure and two windings. The windings occupy sections of the magnetic element that are defined by straight lines.
Figure 3:
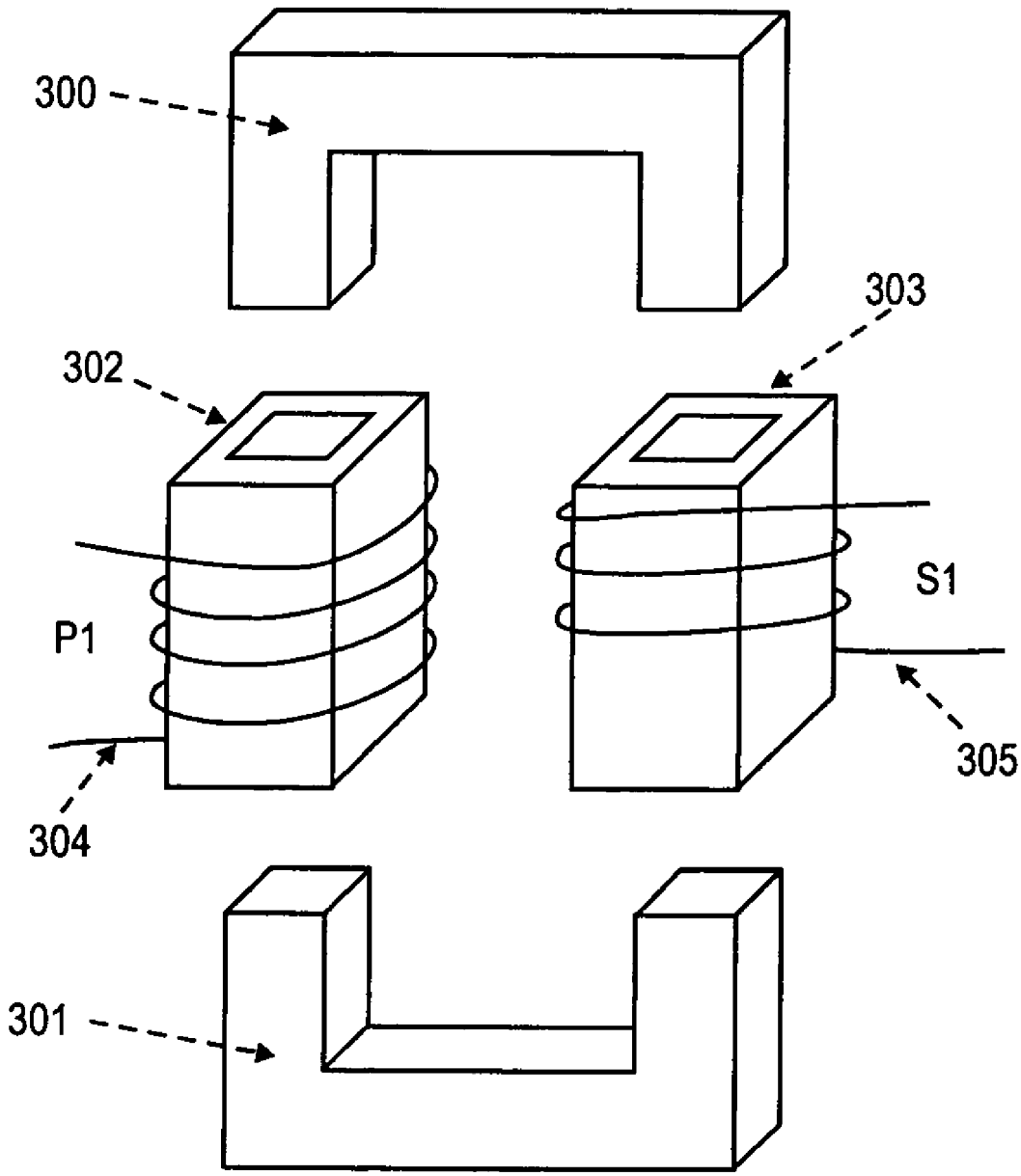
FIG. 3 (PRIOR ART)
FIG. 3 shows a construction of an energy transfer element that is an assembly of two magnetic elements and two bobbins that contain windings.

Embodiments of apparatuses and methods for transferring energy in power converter circuits are disclosed. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

A method for constructing novel yet simple embodiments of energy transfer elements with two or more windings for transferring energy in power converters in accordance with the teachings of the present invention will now be described. The simple construction achieves low cost of manufacture through the use of a magnetic element with an open structure and the absence of a bobbin. The simple energy transfer elements reduce the cost of power converters and power supplies that deliver low output power, which will therefore reduce the manufacturing cost for low power electronic equipment in accordance with the teachings of the present invention. These reductions in cost are especially significant in circuits that use few components, where the cost of the energy transfer element contributes substantially to the total cost of the product.

In one embodiment, a first winding of ordinary magnet wire is wound on a magnetic element without a bobbin. A second winding of triple insulated wire is then wound directly over the first winding. The triple insulated wire allows the construction to meet the electrical isolation requirements of safety agencies.

In another embodiment, a first winding of ordinary magnet wire is wound on a magnetic element without a bobbin. The first winding is covered or encapsulated with an insulating coating. A second winding of ordinary magnet wire is wound directly over the encapsulation or insulating coating of the first winding. The encapsulation or the insulating coating allows the construction to meet the electrical isolation requirements of safety agencies, sparing the added expense of triple insulated wire.

In yet another embodiment, a first winding of ordinary magnet wire is wound on a magnetic element without a bobbin. A sleeve of insulating material is placed over the first winding. A second winding of ordinary magnet wire is wound directly on the sleeve that covers the first winding.

In still another embodiment, a first winding of ordinary magnet wire is wound on a magnetic element without a bobbin. A sleeve of insulating material is placed over the first winding. The sleeve of insulating material has the property that it shrinks when heated. Application of appropriate heating causes the insulating sleeve to conform to the contours of the first winding and the surface of the magnetic element. A second winding of ordinary magnet wire is wound directly on the sleeve that covers the first winding. An additional sleeve of insulation is optionally applied to protect the second winding or to take a third winding. The technique can be extended to accommodate any number of sleeves and windings.

Power converters for high power typically do not use magnetic elements with open structures. The open structures allow magnetic flux from the windings to couple to circuits in ways that are usually unpredictable and undesirable. Hence, power converters for high power typically use magnetic elements with closed magnetic structures. The closed structures substantially confine the magnetic flux to reduce the likelihood of undesirable coupling of magnetic flux from the windings. Undesirable coupling of magnetic flux from open magnetic structures is less likely in low power converters.

In one embodiment of the present invention, a coating of material that has a magnetic permeability greater than free space is applied to the final winding or insulating sleeve. The coating is applied to a sufficient area and with a proper thickness to redirect and confine the magnetic flux from the windings. Redirection and confinement of the magnetic flux from the windings reduces the undesirable coupling of magnetic flux from the windings to circuits.

Figure 4:
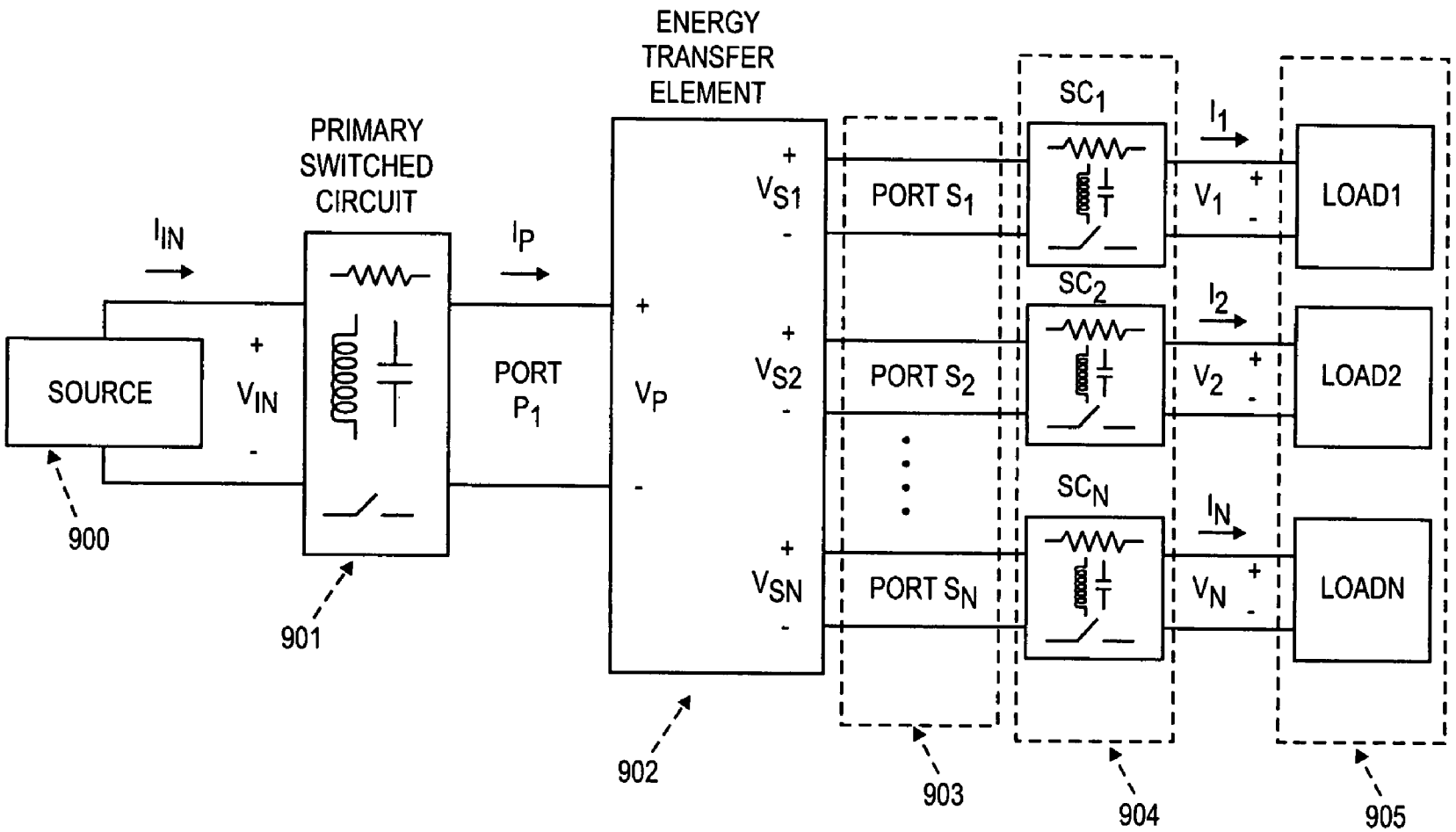
FIG. 4 is a general block diagram that shows the functional elements of a switched mode power converter, illustrating the role of the energy transfer element.

As mentioned, energy transfer elements according to embodiments of the present invention are employed in power converter circuits or power supplies including for example switched mode power supplies. FIG. 4 shows generally the functional elements included in for example a switched mode power converter, illustrating the role of various embodiments of energy transfer elements in accordance with the teachings of the present invention.

Two separate and distinct functions are inherent in an electronic power supply. One is the function of power conversion, performed by a power converter. The other is the function of regulation, performed by a control mechanism acting on the power converter. The typical electronic power converter uses a connection of switches, energy storage elements and energy transfer elements to change the magnitude of one voltage or current to a different magnitude of voltage or current. A control mechanism senses the voltage or current to be regulated, compares the magnitude of the sensed voltage or current to the desired magnitude, and then adjusts the operation of the power converter in a way to reduce the error between the sensed voltage or current and the desired magnitude.

To illustrate, in FIG. 4 an unregulated source 400 is coupled to a primary switched circuit 401 that contains one or more electrical components and switches. For purposes of this disclosure, a switch is any component that can change its state of conduction between a first state that allows the conduction of electrical current and a second state that blocks conduction of electrical current. Switches can be mechanical components or electrical components. The switches may operate actively under external control or they can operate passively in response to the voltages that appear across them or the currents that pass through them.

Primary switched circuit 401 is coupled to the electrical port $P_1$ of energy transfer element 402. An electrical port is a pair of electrical conductors where energy may be supplied or withdrawn. An energy transfer element is a device with at least two electrical ports that allows energy to pass from one port to another port. For purposes of this disclosure, energy transfer elements in power converters are magnetic devices that include a magnetic element with two or more windings. A magnetic element is any structure that has a magnetic permeability substantially greater than free space. A winding is an electrical conductor that couples magnetic flux.

The energy transfer element 402 receives energy at its primary port $P_1$ from primary switched circuit 401. The energy received at primary port $P_1$ is transferred to one or more secondary ports 403. Secondary ports are shown in general as $S_1$ through $S_N$ in FIG. 4. The secondary ports 403 deliver energy to one or more secondary switched circuits 404. Each secondary port delivers energy to a secondary switched circuit that contains one or more electrical components and switches. The secondary switched circuits in FIG. 4 are designated $SC_1$ through $SC_N$. The secondary switched circuits 404 are coupled to one or more loads 405. Each secondary switched circuit is coupled to a load.

The relationship between the voltage at the loads 405 and the voltage at the source 400 is determined by the design of the primary switched circuit 401, the energy transfer element 402 and the secondary switched circuits 404. To make a regulated power supply from the power converter, a circuit or other mechanism is employed to adjust the operation of the switched circuits to maintain a desired voltage or current at one or more of the loads. The adjustments may be made to either the primary switched circuit 401, the secondary switched circuits 404, or to both 401 and 404. In accordance with the teachings of the present invention, the operation of the switched circuits may employ a variety of techniques. For instance, various embodiments include the switching to occur at a fixed frequency or at a variable frequency. In one embodiment, the duty cycle of the switching waveforms may be varied using pulse width modulation. In one embodiment, the frequency of the switching may be varied using a variety of techniques using for example a self-oscillating mode of operation or cycle skipping control. It is appreciated that other suitable types of techniques may be employed to adjust the operation of the switched circuits in power supplies in accordance with the teachings of the present invention.

Figure 5:
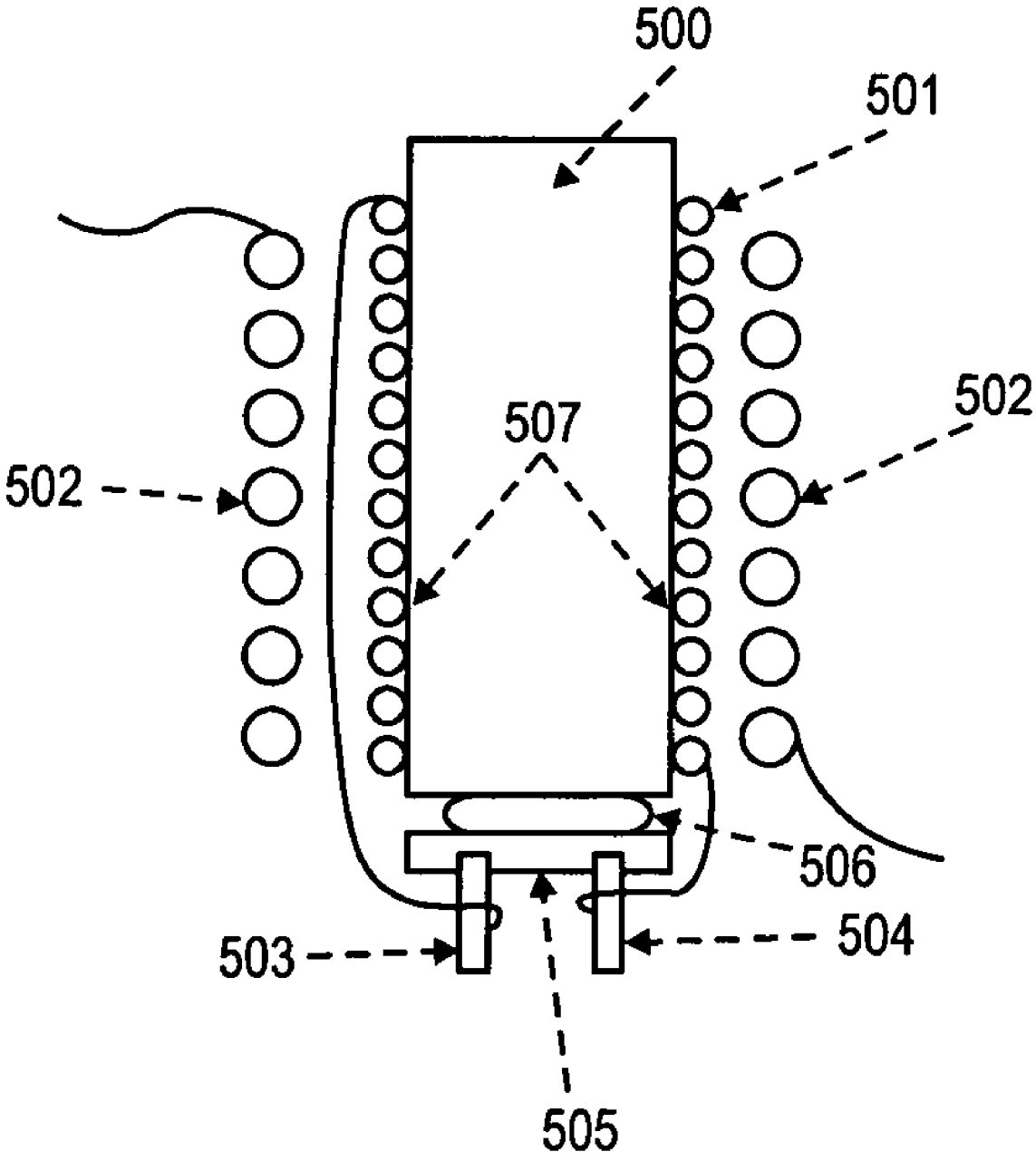
FIG. 5 shows a pseudo cross-sectional view of one embodiment of an energy transfer element with two windings according to the teachings of the present invention.

Referring generally now to energy transfer elements according to embodiments of the present invention, one example embodiment of the present invention uses a magnetic element with a characteristic physical structure that allows turns of wire to be applied by hand or by machine without mechanical complications that would increase the manufacturing cost. To illustrate, FIG. 5 illustrates one embodiment of an energy transfer element including a magnetic element 500 in a first cross section that represents an open rod structure that has a substantially cylindrical geometry. Thus, a second cross section perpendicular to the plane of the paper and perpendicular to the long sides 507 to reveal the features in the third dimension would show, in one embodiment, a substantially circular geometry for the magnetic element 500. As such, the external surface of one embodiment of magnetic element 500 is a substantially curved surface. In another embodiment, a second cross section of magnetic element 500 perpendicular to the plane of the paper and perpendicular to the long sides 507 may be substantially polygonal such that an external surface of one embodiment of magnetic element 500 is substantially planar. Thus, the long sides 507 of the magnetic element 500 could be sections of planes with flat surfaces rather than curved surfaces. In various embodiments, magnetic element 500 has an open structure with a section that can easily accept turns of wire that comprises a first winding 501 directly on its surface without a bobbin in accordance with the teachings of the present invention. The absence of a bobbin reduces the manufacturing cost in accordance with the teachings of the present invention. One embodiment of the present invention allows the turns of wire to be wound directly around an external surface of magnetic element 500 without the use of a bobbin.

In one embodiment, magnetic element 500 may include a coating to protect the external surface and to reduce abrasion of windings. For purposes of this disclosure, a coating on the external surface of the magnetic element is an integral part of magnetic element 500; therefore, the surface of the coating shall have the same meaning as the surface of the magnetic element 500 in this disclosure.

In one embodiment, winding 501 is an ordinary magnet wire. One with ordinary skills in the art having the benefit of this disclosure will recognize magnet wire as a single strand copper wire in standard diameters with an insulating coating. The insulating coating is typically a composition of one or more substances such as enamel, polyimide, nylon, polyurethane or similar insulating materials.

In one embodiment, the ends of the winding 501 are coupled to conductive pins 503 and 504. In the embodiment of FIG. 5, an insulator 505 holds the conductive pins 503 and 504. In one embodiment, insulator 505 is attached to the magnetic element 500 by means of an adhesive 506. The pins 503 and 504 are electrical terminals for the first winding 501. Pins 503 and 504 also provide mechanical mounting for the energy transfer device when they are inserted into a circuit board. In another embodiment, pins 503 and 504 can be held by means other than the single insulator 505, and pins 503 and 504 can be attached at different places on magnetic element 500. In yet another embodiment, the energy transfer element does not include pins 503 and 504 and this embodiment may be employed in applications where it is desired to couple to the ends of the first winding 501 by a different means.

As illustrated in the embodiment of FIG. 5, a second winding 502 is applied directly over first winding 501. The ends of second winding 502 are not coupled to pins. The absence of additional pins reduces the manufacturing cost. In operation, energy to be received from a power converter circuit input is to be transferred from the first winding 501 to the second winding 502 through a magnetic coupling provided between first and second windings 501 and 502 by the magnetic element 500 to a power converter circuit output. One embodiment of the present invention allows the turns of wire making up windings 501 and 502 to be wound directly around the external surface of the magnetic element without having to thread the wire through an opening defined by the magnetic element 500. In another embodiment, a third winding (not shown) may also be wound around magnetic element 500 such that there is a magnetic coupling provided between first and third windings by the magnetic element 500. Similarly, energy is transferred from the first winding to the third winding through the magnetic coupling provided between first and third windings by the magnetic element 500 in accordance with the teachings of the present invention. Thus, it is appreciated that two or more windings are wound around an external surface of magnetic element 500 without a bobbin in an energy transfer element in accordance with the teachings of the present invention. It is therefore further appreciated that additional windings consisting of one or more turns can be used to provide additional power conversion circuit outputs or as shield windings to improve electromagnetic interference performance of the power conversion circuit in accordance with the teachings of the present invention. It is appreciated that the additional windings can be constructed of ordinary magnet wire or a conductive foil or tape or other suitable equivalents.

In one embodiment, the wire of winding 502 has three layers of insulation or triple insulated such that the requirements of safety agencies are met. In one embodiment, triple insulated wire requires no additional insulating barrier to isolate a circuit coupled to a first winding from a circuit coupled to the triple insulated wire.

In another embodiment, the addition of an insulating material to separate the first winding from the second winding is employed, which allows the use of ordinary magnet wire for both first and second windings. The cost of ordinary magnet wire is generally substantially less than the cost of triple insulated wire. The total manufacturing cost can be reduced when there is a lower cost alternative to the use of triple insulated wire.

Figure 6:
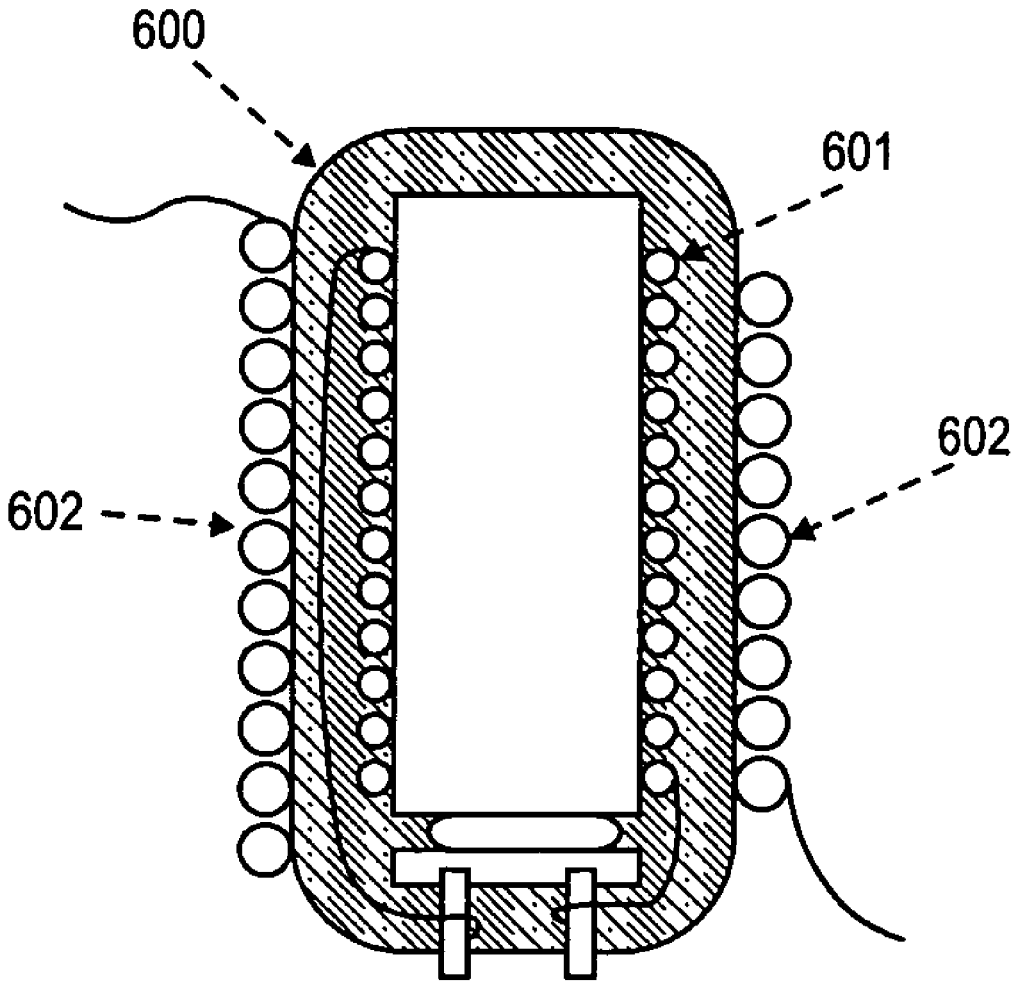
FIG. 6 shows a pseudo cross-sectional view of an embodiment of an energy transfer element with two windings separated by an insulating coating according to the teachings of the present invention.

To illustrate, FIG. 6 shows an embodiment of the present invention that includes a coating of insulating material 600 that separates the first winding 601 from the second winding 602. The insulating material 600 is of sufficient dimension and dielectric strength to satisfy the requirements of safety agencies for electrical isolation between a first winding and a second winding. In the illustrated embodiment, the first winding 601 and the second winding 602 are ordinary magnet wire.

Figure 7:
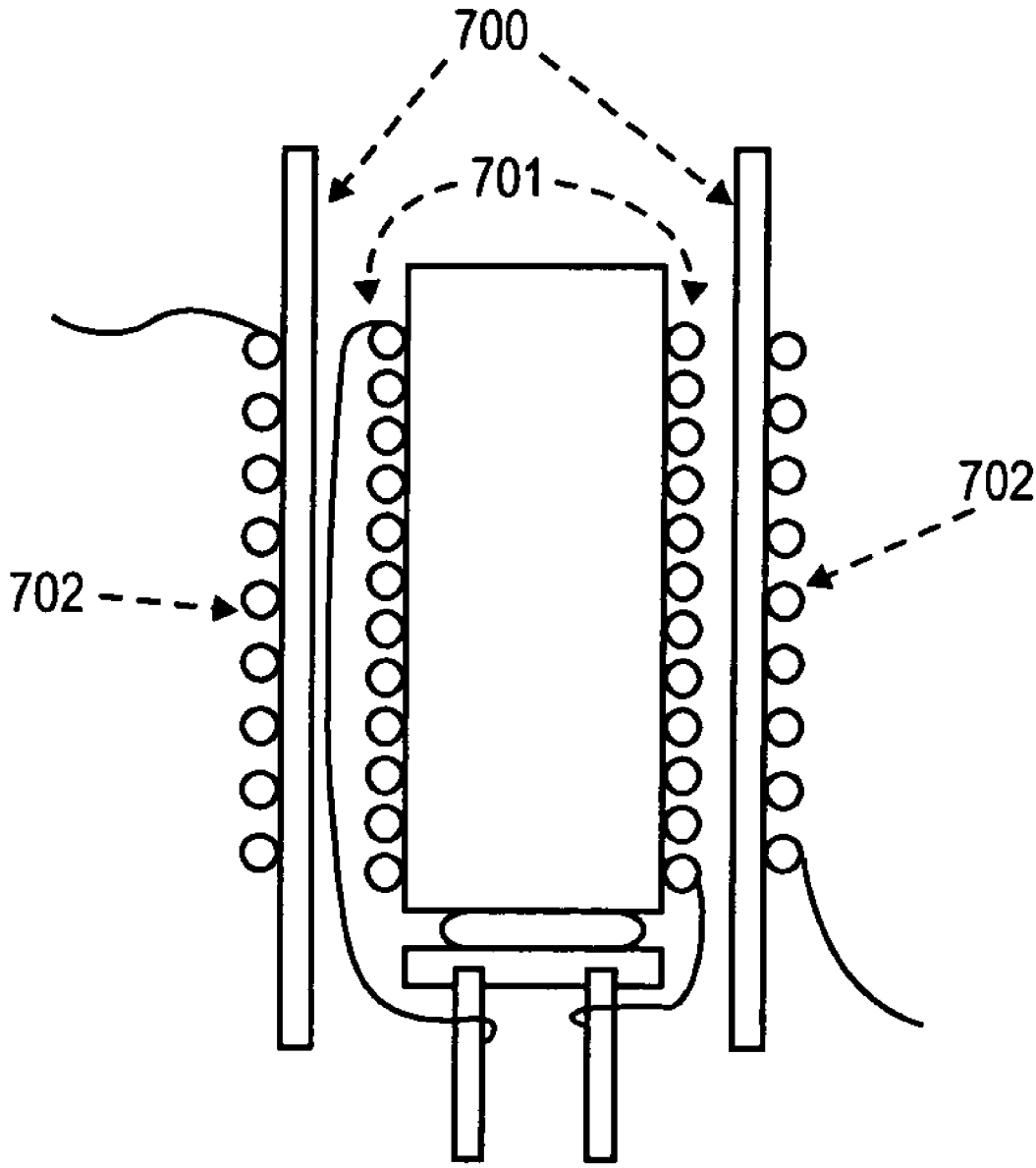
FIG. 7 shows a pseudo cross-sectional view of an embodiment of an energy transfer element with two windings separated by an insulating sleeve according to the teachings of the present invention.

FIG. 7 shows one embodiment of the present invention that has a sleeve 700 of insulating material between a first winding 701 and a second winding 702. The dielectric strength of the insulating material is sufficiently high and the length of the sleeve extends sufficiently past the winding 702 to meet the requirements of safety agencies for electrical isolation between a first winding and a second winding. The use of a sleeve 700 of insulating material is an alternative to the coating of insulating material 600 in the embodiment illustrated in FIG. 6. In one embodiment, the sleeve 700 of insulating material is a flexible tube of a crosslinked polymer that shrinks when it is heated to a temperature, known as the shrink temperature, which depends on the particular material. This product has the common name of heat shrink tubing. The heat shrink tubing undergoes a permanent reduction in size after it reaches the shrink temperature. In one embodiment, the sleeve 700 after shrinking holds the first winding tightly to the magnetic element and forms a suitable surface to accept the turns of a second winding.

Figure 8:
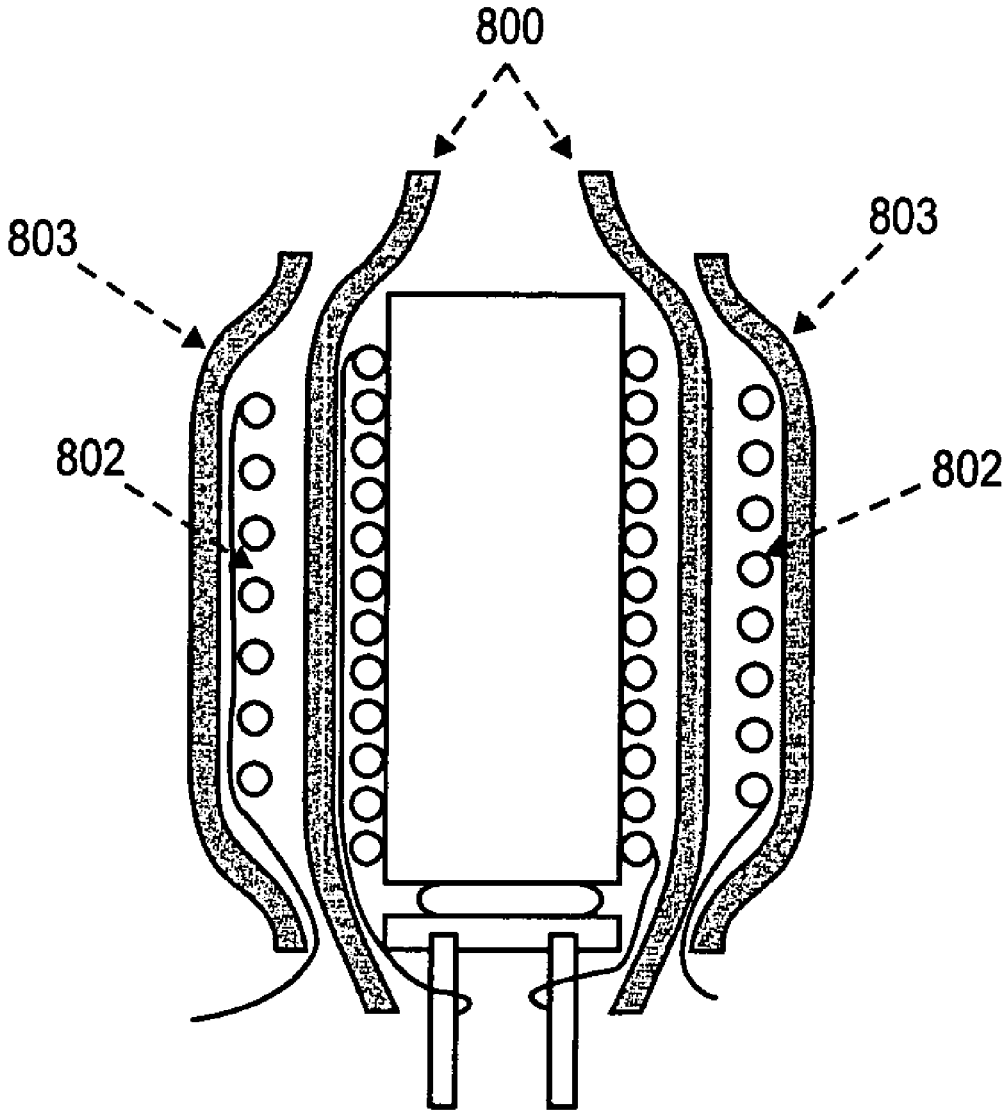
FIG. 8 shows a pseudo cross-sectional view of an embodiment of an energy transfer element with two windings that are separated and covered by insulating sleeves according to the teachings of the present invention.

FIG. 8 shows one embodiment of the present invention that uses a first sleeve that could be made of heat shrink tubing 800 to separate a first winding 801 from a second winding 802. A second sleeve of heat shrink tubing 803 covers the second winding 802. In the illustrated embodiment, the dielectric strength of heat shrink tubing 800 is sufficiently high and the length of the heat shrink tubing 800 extends sufficiently past the winding 801 to meet the requirements of safety agencies for electrical isolation between a first winding 801 and a second winding 802.

Figure 9:
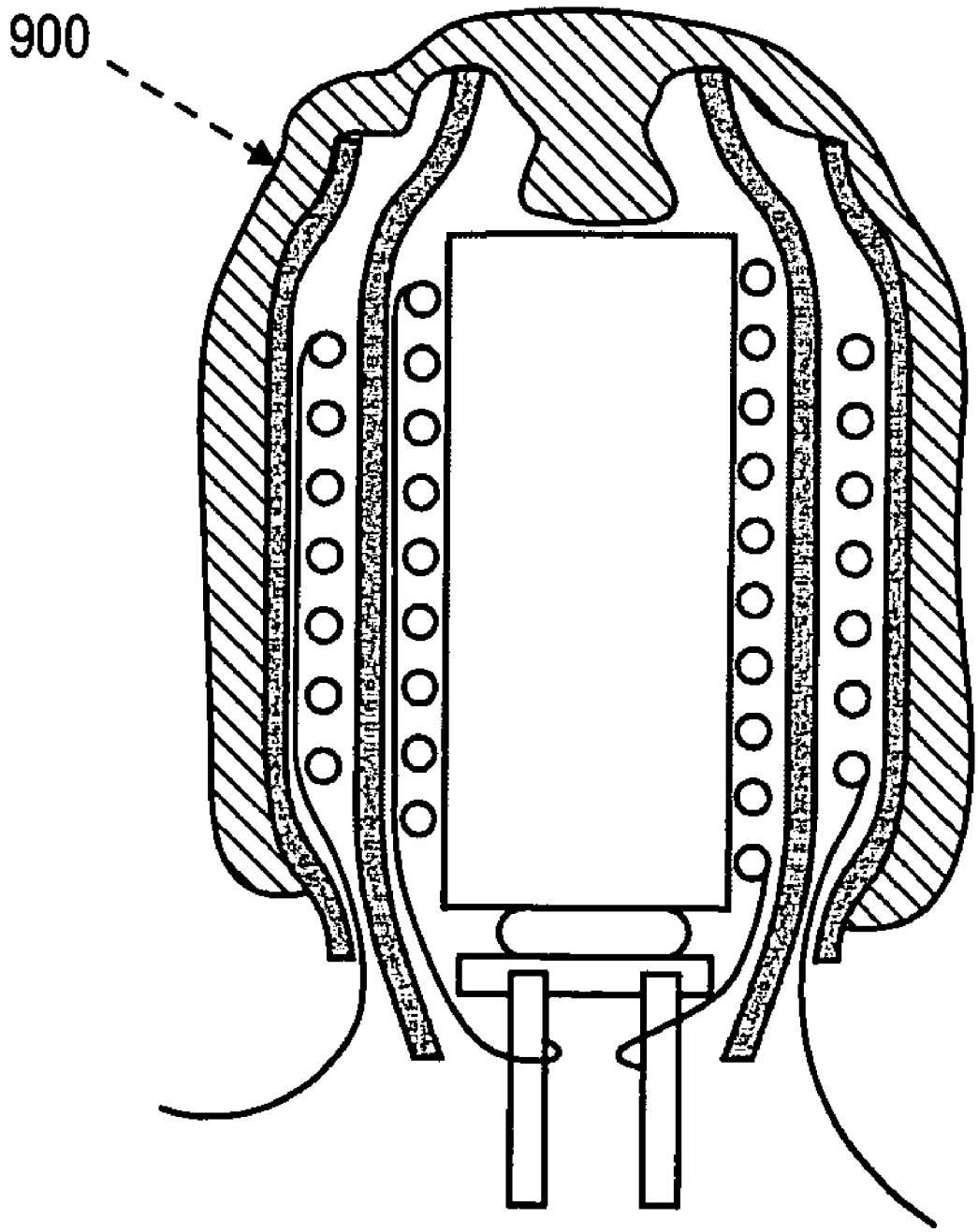
FIG. 9 shows a pseudo cross-sectional view of an embodiment of an energy transfer element that is coated with a material having a magnetic permeability substantially greater than free space, covering two windings that are separated and covered by insulating sleeves, according to the teachings of the present invention.

FIG. 9 shows one embodiment of the present invention that has an exterior coating 900 of a material having magnetic permeability substantially greater than free space. In one embodiment the exterior coating 900 can be comprised of fine particles of magnetic material mixed with a nonmagnetic liquid such that the mixture is substantially homogeneous. The mixture is applied to the exterior of the energy transfer element by painting, dipping, or other suitable means according to various embodiments of the present invention. In one embodiment, the mixture changes state from liquid to solid through a curing process that is completed after the exterior coating 900 is applied. The thickness of the exterior coating 900 and the extent that it covers the exterior surface are determined by the parameters of the manufacturing process. The thickness of the exterior coating 900 and the area that it covers are selected based on the effective permeability of the coating material to achieve the desired redirection and confinement of the magnetic flux from the windings. The thickness of the exterior coating 900 and the area that it covers can be selected to adjust the inductance of the windings.

Figure 10:
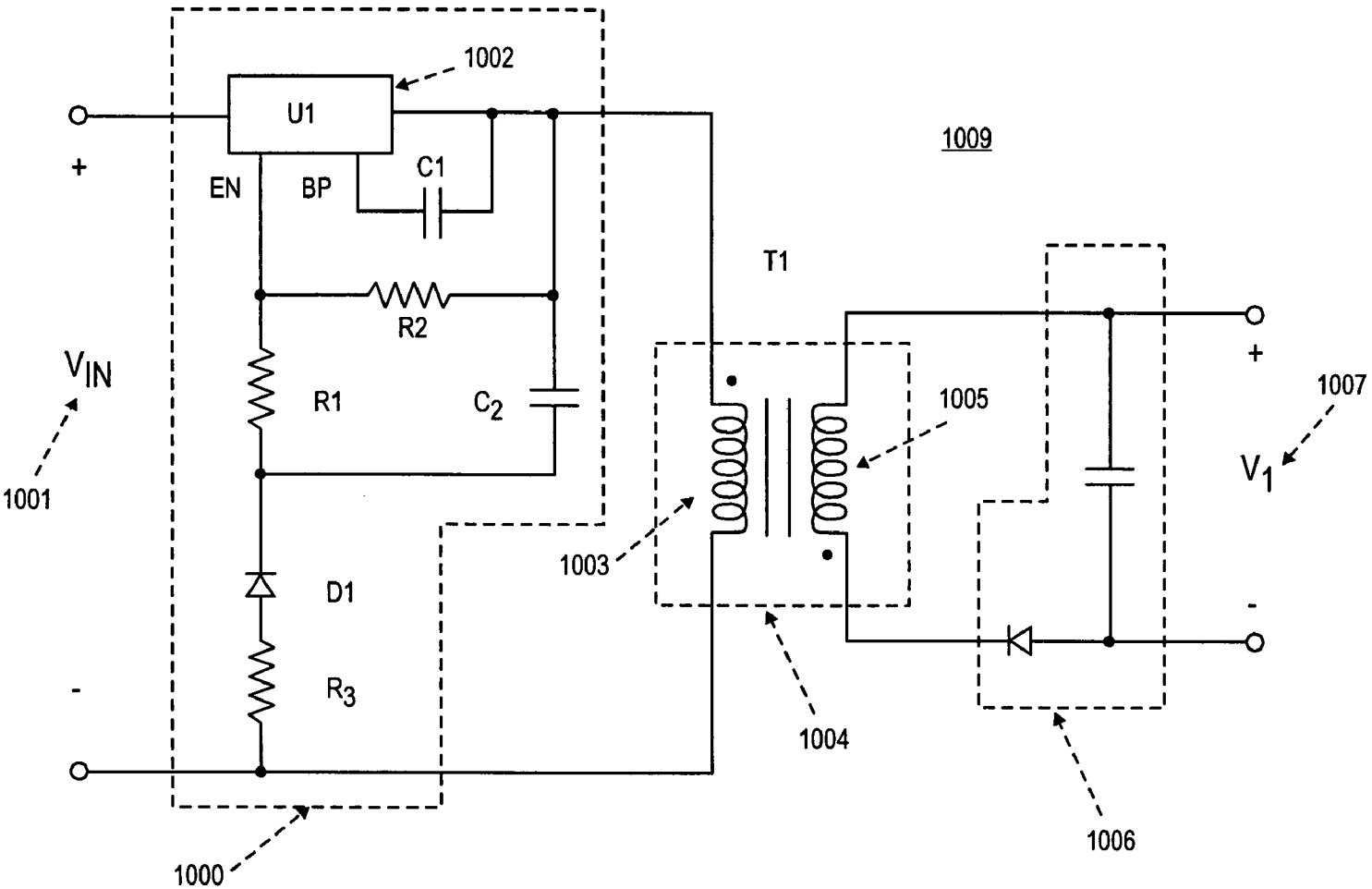
FIG. 10 is one embodiment of an electrical circuit diagram of a power converter circuit that employs an embodiment of the simple energy transfer element according to the teachings of the present invention.

FIG. 10 is an electrical schematic diagram that shows generally one embodiment a power converter 1009 that is also a regulated power supply including an energy transfer element in accordance with the teachings of the present invention. As shown, a primary switched circuit 1000 couples an input voltage 1001 by means of the integrated circuit 1002 to a first port 1003 of the energy transfer element 1004. In one embodiment, input voltage 1001 is a DC voltage that has been provided with suitable rectification circuitry (not shown) from an AC input voltage using known techniques. Energy is transferred from the first port 1003 that is also a first winding of an energy transfer element in accordance with the teachings of the present invention to a second port 1005 of the energy transfer element. The second port 1005 is also a second winding of the present invention. The second port 1005 is coupled to the secondary switched circuit 1006. In one embodiment, secondary switched circuit 1006 produces a voltage 1007 that is to be coupled to an appropriate load.

In one embodiment, the integrated circuit 1002 includes a power supply regulator, which contains a power switch with the necessary control circuits to couple the input voltage 1001 with appropriate timing and duration to the first port 1003 in order to regulate the voltage 1007. In one embodiment, the voltage 1007 to be regulated is available to the integrated circuit 1002 at the first port 1003 of the energy transfer element 1004. The electrical components in the primary switched circuit 1000 provide information from the first port 1003 to integrated circuit 1002. The integrated circuit 1002 has an internal switch.

In one embodiment, integrated circuit 1002 uses the information from the components in the primary switched circuit 1000 to adjust the switching of the internal switch to achieve the desired regulation of the voltage 1007 and or the current flowing in switched circuit 1006. In one embodiment, the integrated circuit 1002 may use one of several control techniques in order to perform the function of adjusting the switching of the internal switch including fixed frequency PWM control, variable frequency control, variable frequency self oscillating control and cycle skipping control. One skilled in the art having the benefit of this disclosure will appreciate the fact that the control technique used by the integrated circuit 1002 is sometimes used to describe the operation of the overall power conversion circuit 1009. In one embodiment, input voltage 1001 is a DC input voltage.

In the foregoing detailed description, the method and apparatus of the present invention have been described with reference to specific exemplary embodiments thereof. It will, however, be evident that various modifications and changes may be made thereto without departing from the broader spirit and scope of the present invention. The present specification and figures are accordingly to be regarded as illustrative rather than restrictive.

What is claimed is:

1. A method, comprising:

receiving energy from a power converter circuit input with a first winding wound around an external surface of a magnetic element without a bobbin;

transferring the energy from the first winding to a second winding wound around the external surface of the magnetic element without the bobbin through a magnetic coupling provided by the magnetic element between the first and second windings;

coupling the energy from the second winding to a power converter circuit output; and regulating the energy transferred from the power converter circuit input to the power converter circuit output by switching a connection between the power converter circuit input and the first winding in response to the power converter circuit output.

2. The method of claim 1 wherein switching the connection between the power converter circuit input and the first winding comprising switching the connection at a fixed frequency.

3. The method of claim 1 wherein switching the connection between the power converter circuit input and the first winding comprising switching the connection at a variable frequency.

4. The method of claim 1 wherein switching the connection between the power converter circuit input and the first winding comprising switching the connection with cycle skipping control.

5. The method of claim 1 wherein switching the connection between the power converter circuit input and the first winding comprising switching the connection with pulse width modulation.

6. The method of claim 1 further comprising:

rectifying an alternating current (AC) source to provide direct current (DC) source energy; and coupling the DC source energy to be received by the power converter circuit input.

7. The method of claim 1 further comprising transferring the energy from the first winding to a third winding wound around the external surface of the magnetic element without the bobbin through the magnetic coupling provided by a magnetic element between the first and third windings.

8. The method of claim 1 further comprising insulating the second winding from the first winding.

9. The method of claim 8 further comprising triple insulating the second winding to insulate the first winding from the second winding.

10. The method of claim 8 further comprising coating the first winding and the magnetic element with an insulating material to insulate the first winding from the second winding.

11. The method of claim 8 further comprising spraying the first winding and the magnetic element with an insulating material to insulate the first winding from the second winding.

12. The method of claim 8 further comprising enclosing the first winding and the magnetic element in an insulative sleeve to insulate the first winding from the second winding.

13. The method of claim 12 further comprising heating heat shrink tubing enclosing the first winding and the magnetic element to insulate the first winding from the second winding.

14. The method of claim 1 further comprising coupling each end of the first winding to a respective one of the two electrically conductive pins mounted to the magnetic element through electrically insulating material without coupling both ends of the second winding to electrically conductive pins mounted to the magnetic element through electrically insulating material.

15. The method of claim 1 further comprising coating at least a portion of an energy transfer element formed with the first and second windings would around the magnetic element with a material having a magnetic permeability substantially greater than free space.

* * * * *